US005141075A

United States Patent [19]

Brett

[11] Patent Number: 5,141,075

[45] Date of Patent: Aug. 25, 1992

[54] PORTABLE POOL SAFETY LADDER

[75] Inventor: James E. Brett, Huntington Beach, Calif.

[73] Assignee: Brett Aqualine, Inc., Huntington Beach, Calif.

[21] Appl. No.: 588,707

[22] Filed: Sep. 27, 1990

[51] Int. Cl.[5] ..... B63B 27/00

[52] U.S. Cl. ..... 182/97; 182/118; 182/129

[58] Field of Search ..... 182/93, 97, 118, 129, 182/106; 114/362

[56] References Cited

U.S. PATENT DOCUMENTS

| | | | |
|---|---|---|---|
| 2,996,729 | 8/1961 | Bailey | 182/118 |
| 3,052,896 | 9/1962 | Beach | 182/97 |
| 3,390,740 | 7/1968 | Brandel | 182/118 |
| 3,973,644 | 8/1976 | Martinez | 182/97 |
| 4,541,507 | 9/1985 | Gibellato | 182/97 |
| 4,572,330 | 2/1986 | Langevin | 182/93 |
| 4,716,987 | 1/1988 | Lindberg | 182/97 |

*Primary Examiner*—Reinaldo P. Machado
*Attorney, Agent, or Firm*—Louis J. Bachand

[57] ABSTRACT

A portable swimming pool ladder 20 is provided which pivots out of reach of children on a tethering strap 32 secured within the pool 10.

12 Claims, 1 Drawing Sheet

PORTABLE POOL SAFETY LADDER

FIELD OF THE INVENTION

Figure 1:
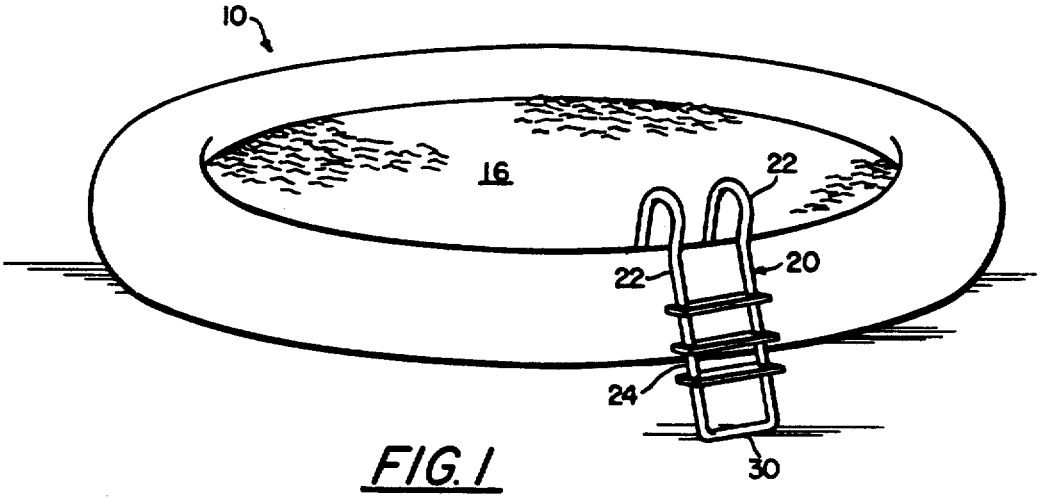

This invention relates to improvements in entry and exit ladders for portable swimming pools, and more particularly to pool ladders which provide ease of entry and exit to portable pools, and which are readily stored in place without being accessible to children.

BACKGROUND OF THE INVENTION

The term portable pools, is used herein to refer to all manner of above-ground recreational pools including those with inflatable side walls, and those having a rigid wall and a plastic film liner. In both types of above ground pools there is a potential safety problem if children can have access to the pool when there is no adult supervision in the area. Such access can be by means of ladders normally used to enable both children and adults to enter the pool, if the ladder is not removed.

Through forgetfulness, carelessness or mere inattention, such access ladders can be left in place, or left in the vicinity of the pool, avoiding the inconvenience of storage, and can be used by children unable to swim alone in safety to gain access to the pool.

SUMMARY OF THE INVENTION

It is accordingly an object of the present invention to provide a pool safety ladder which provides access to a portable pool but which is readily self-storing out of the reach of children.

This and other objects of the invention to become apparent hereinafter are realized in accordance with the invention in a safety ladder for a portable pool having a generally upright wall extending above ground level, comprising a series of rungs and a pair of parallel rails arranged as a ladder for use in entering and exiting the pool over the wall from ground level and reverse continued extents of the rails within the pool, and means tethering the ladder by its continued extents within the pool for positioning the ladder within the pool for safety or without the pool for use as a ladder by pivoting movement about the tethering means.

In this and like embodiments, typically: the tethering means comprises a strap anchored within the pool and of a length to permit positioning of the ladder outside the pool; the continued rail extents are parallel and there is included also a series of rungs carried by said rail extents for use in exiting said pool from within the pool; and, there is also included a cross-member between said continued rail extents at their outer terminus, the tethering means being attached to the cross-member.

The invention further contemplates the combination of the safety ladder and a portable swimming pool, including such a pool comprising a floor and a generally toroidal wall for enclosing pool water, and wherein the tethering means is anchored or otherwise secured to the pool at the juncture of the pool wall and floor.

In another embodiment, there is provided a safety ladder for portable swimming pools comprising a floor and a generally toroidal wall for containing pool water, the ladder comprising a pair of parallel U-shaped rails in which the U is sufficiently open to straddle the pool wall, a plurality of transverse rungs attached to the rails in opposed sets, cross-members connecting the rails at their ends, and tethering means on one of the cross-members for anchoring said ladder within said pool, the tethering means being of a length to permit bodily displacement of the ladder between a position with the ladder rungs accessible outside the pool wall and a position with the ladder rungs not accessible outside the pool wall, the ladder pivoting on the tethering means at the cross-member; and the ladder in combination with the pool.

THE DRAWING

Figure 2:
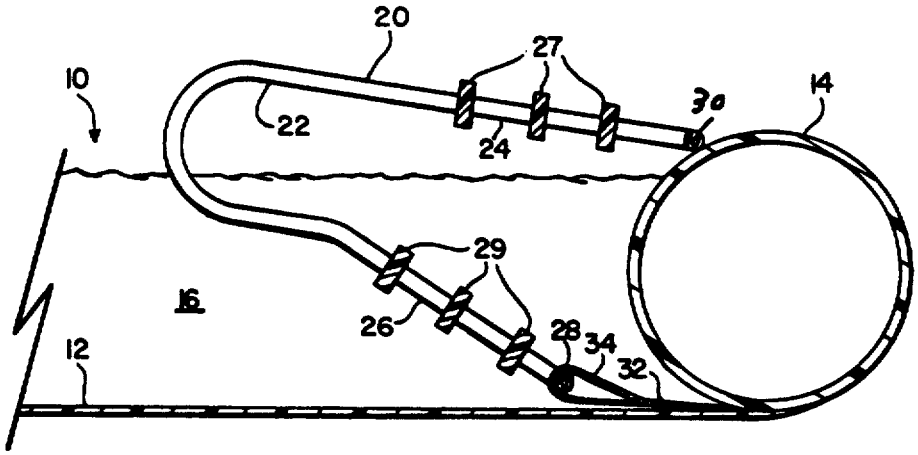

The invention will be further described as to an illustrative embodiment in conjunction with the attached drawings in which:

FIG. 1 is a perspective view of the invention safety ladder in the use condition on a portable pool; and, FIG. 2 is a view in vertical section and partly in elevation showing the invention pool safety ladder in the stored condition.

PREFERRED MODES

As will be observed from a consideration of FIGS. 1 and 2, the present safety ladder affords all possible convenience in entering or leaving a portable pool and offers ease of storage out of the possibility of child use with but a simple rotation of the ladder around the pool wall and into the pool water.

In the drawing, the pool is shown at 10 and is a typical inflatable portable pool comprising a floor 12 and a side wall 14 generally toroidal, and with the floor containing the pool water 16.

The ladder 20 comprises a pair of rails 22, arranged in parallel, as shown, and generally U-shaped with an outer extent 24 on one side of the U-bend to be located outside the pool, and a reverse turned, continued extent 26 on the other side of the U-bend to be located within the pool 10 in the use condition of the ladder, FIG. 1. Two sets of three rungs 27, 29 are provided extended transversely of the rails 22 and opposite one another across the pool wall 14 for ease of entry or egress relative to the pool 10.

A pair of cross-members 28, 30 join the respective terminus of the rail extends together as shown.

The ladder 20 is further provided with a tether 32, a strap having a loop 34 fitted around the cross-member 28 at one end and secured, as by stitching or melt adhesion, at the other end to the pool at the juncture of the floor 12 and the wall 14.

It will be seen that the ladder 20 is limited in its displaceability by the tether 32 to positions of use and storage respectively. When use of the ladder is desired, the ladder is pulled over the wall, pivoting at the end of the tether 32, until the tether is fully extended, a condition corresponding to the ladder being in the position shown in FIG. 1.

When storage is desired, the ladder 20 is tipped back over the pool wall 14, a movement limited and guided by the tether 32. The positioning and length of tether 32 ensure that the ladder is at hand, ready for redeployment at all times, thus increasing the likelihood that the ladder will be properly stowed after pool use, since the inconvenience of other storage alternatives is avoided.

I claim:

1. Safety ladder for a portable pool having a generally upright wall extending above ground level, comprising a series of rungs and a pair of parallel rails arranged as a ladder for use in entering and exiting the pool over said wall from ground level and reverse continued extents of said rails within said pool, and means tethering said ladder by its continued extents within said pool for positioning said ladder within the pool for safety or without the pool for use as a ladder by pivoting movement about said tethering means.

2. Safety ladder according to claim 1, in which said tethering means comprises a strap anchored within said pool and of a length to permit positioning of said ladder outside said pool.

3. Safety ladder according to claim 1, in which said continued rail extents are parallel and including also a series of rungs carried by said rail extents for use in exiting said pool from within the pool.

4. Safety ladder according to claim 1, including also a cross-member between said continued rail extents at their outer terminus, said tethering means being attached to said cross-member.

5. Safety ladder according to claim 4, in which said tethering means comprises a strap anchored within said pool and of a length to permit positioning of said ladder outside said pool.

6. Safety ladder according to claim 5, in which said continued rail extents are parallel and including also a series of rungs carried by said rail extents for use in exiting said pool from within said pool.

7. In combination: the safety ladder of claim 1 and a portable swimming pool.

8. The combination according to claim 7, in which said swimming pool comprises a floor and a generally toroidal wall for enclosing pool water, said tethering means being secured to said pool at the juncture of said pool wall and floor.

9. In combination: the safety ladder of claim 6 and a portable swimming pool.

10. The combination according to claim 9, in which said swimming pool comprises a floor and a generally toroidal wall for containing pool water, said tethering strap being anchored to said pool at the juncture of said pool wall and floor.

11. Safety ladder for portable swimming pools comprising a floor and a generally toroidal wall for containing pool water, said ladder comprising a pair of parallel U-shaped rails in which the U is sufficiently open to straddle said pool wall, a plurality of transverse rungs attached to said rails in opposed sets, cross-members connecting said rails at their ends, and tethering means on one of said cross-members for anchoring said ladder within said pool, said tethering means being of a length to permit bodily displacement of said ladder between a position with the ladder rungs accessible outside the pool wall and a position with the ladder rungs not accessible outside the pool wall, said ladder pivoting on said tethering means at said cross-member.

12. In combination: the ladder according to claim 11 and a portable swimming pool having a floor and a generally toroidal wall for containing water.

* * * * *